US006158845A

United States Patent [19]

Chwalek et al.

[11] Patent Number: 6,158,845

[45] Date of Patent: Dec. 12, 2000

[54] INK JET PRINT HEAD HAVING HEATER UPPER SURFACE COPLANAR WITH A SURROUNDING SURFACE OF SUBSTRATE

[75] Inventors: James M. Chwalek, Pittsford; Gilbert A. Hawkins; Constantine N. Anagnostopoulos, both of Mendon, all of N.Y.

[73] Assignee: Eastman Kodak Company, Rochester, N.Y.

[21] Appl. No.: 09/335,415

[22] Filed: Jun. 17, 1999

[51] Int. Cl.[7] ..... B41S 2/05

[52] U.S. Cl. ..... 347/56; 347/62

[58] Field of Search ..... 347/56, 65, 46, 347/54, 55, 57, 60–62, 64, 67, 73, 74

[56] References Cited

U.S. PATENT DOCUMENTS

| | | | |
|---|---|---|---|
| 1,941,001 | 12/1933 | Hansell . | |
| 3,878,519 | 4/1975 | Eaton . | |
| 4,490,728 | 12/1984 | Vaught et al. . | |
| 5,726,693 | 3/1998 | Sharma et al. | 347/54 |
| 5,812,159 | 9/1998 | Anagnostopoulos et al. | 347/55 |
| 5,825,385 | 10/1998 | Siberbrook | 347/56 |
| 5,880,759 | 3/1999 | Silverbrook | 347/55 |

FOREIGN PATENT DOCUMENTS 2007162 10/1978 United Kingdom .

*Primary Examiner*—John Barlow
*Assistant Examiner*—Juanita Stephens
*Attorney, Agent, or Firm*—Milton S. Sales

[57] ABSTRACT

Apparatus for controlling ink in an ink jet printer includes a print head of the type wherein ink forms a meniscus above a nozzle bore and spreads along an upper surface of the print head. The print head includes a substrate having an upper surface; an ink delivery channel below the substrate; and a nozzle bore through the substrate and opening below the substrate into the ink delivery channel to establish an ink flow path. A source of pressurized ink communicates with the ink delivery channel such that ink tends to form a meniscus on the upper surface of the heater. A resistive heater lies about at least a portion of the nozzle bore, the heater having an upper surface which is coplanar with a surrounding portion of the upper surface of the substrate, whereby the print head is flat in regions along an ink-to-solid contact line of the meniscus.

10 Claims, 10 Drawing Sheets

INK JET PRINT HEAD HAVING HEATER UPPER SURFACE COPLANAR WITH A SURROUNDING SURFACE OF SUBSTRATE

CROSS REFERENCE TO RELATED APPLICATIONS

Reference is made to commonly assigned, co-pending U.S. patent application Ser. No. 08/954,317 entitled CONTINUOUS INK JET PRINTER WITH ASYMMETRIC HEATING DROP DEFLECTION filed in the names of Chwalek, Jeanmaire, and Anagnostopoulos on Oct. 17, 1997.

FIELD OF THE INVENTION

This invention relates generally to the field of ink jet print heads in which there is drop ejection apparatus wherein a heater acts on a fluid or fluid meniscus (air-ink interface) of ink to be ejected.

BACKGROUND OF THE INVENTION

Ink jet printing has become recognized as a prominent contender in the digitally controlled, electronic printing arena because, e.g., of its non-impact low-noise characteristics, its use of plain paper, and its avoidance of toner transfers and fixing. Ink jet printing mechanisms can be categorized as either continuous ink jet or drop on demand ink jet.

Great Britain Patent No. 2,007,162, which issued to Endo et al. in 1979, discloses an electrothermal drop on demand ink jet printer which applies a power pulse to an electrothermal heater which is in thermal contact with water based ink in a nozzle. A small quantity of ink rapidly evaporates, forming a bubble which cause drops of ink to be ejected from small apertures along the edge of the heater substrate. This technology is known as Bubblejet™ (trademark of Canon K.K. of Japan). U.S. Pat. No. 4,490,728, which issued to Vaught et al. in 1982, discloses an electrothermal drop ejection system which also operates by bubble formation to eject drops in a direction normal to the plane of the heater substrate. Rapid bubble formation provides the momentum for drop ejection.

Commonly assigned U.S. Pat. No. 5,880,759 which issued to Kia Silverbrook on Mar. 9, 1999, discloses a drop on demand liquid printing system wherein drop ejection is effected by selective actuation of a heater acting on the meniscus (the ink-air interface) of ink to be ejected. For this class of printer, the heater element may take the form of a ring or a part of a ring at the top surface of the print head. The top surface through which the orifices open generally defines an "orifice plane." The placement accuracy of ejected drops is influenced by the line of contact between the meniscus of the ink to be ejected and the top surface of the print head. If the contact line between the ink and the orifice surface is not symmetrically disposed about the orifice, the drops will not necessarily be ejected in a desired direction perpendicular to the orifice plane.

Continuous ink jet printing dates back to at least 1929. See U.S. Pat. No. 1,941,001 to Hansell. Conventional continuous ink jet utilizes electrostatic charging tunnels that are placed close to the point where the drops are formed in a stream. In this manner individual drops may be charged. The charged drops may be deflected downstream by the presence of deflector plates that have a large potential difference between them. A gutter (sometimes referred to as a "catcher") may be used to intercept the charged drops, while the uncharged drops are free to strike the recording medium. U.S. Pat. No. 3,878,519, which issued to Eaton in 1974, discloses a method and apparatus for synchronizing droplet formation in a liquid stream using electrostatic deflection by a charging tunnel and deflection plates.

In another class of continuous ink jet printers, such as disclosed in commonly assigned, co-pending U.S. patent application Ser. No. 08/954,317 entitled CONTINUOUS INK JET PRINTER WITH ASYMMETRIC HEATING DROP DEFLECTION filed in the names of Chwalek, Jeanmaire, and Anagnostopoulos on Oct. 17, 1997, an ink jet printer includes a delivery channel for pressurized ink to establish a continuous flow of ink in a stream flowing from a nozzle bore in a direction of propagation related to the orifice plane. A heater having a selectively-actuated section associated with only a portion of the nozzle bore perimeter causes the stream to break up into a plurality of droplets at a position spaced from the heater. Actuation of the heater section produces an asymmetric application of heat to the stream to control the direction of the stream between a print direction and a non-print direction. The placement accuracy of ejected drops is influenced by the line of contact between the meniscus of the ink to be ejected and the surface of the orifice from which the drops are ejected.

For drop ejection apparatus in which a heater acts on the ink-air interface of ink to be ejected, the need to contact the heater electrically has made it difficult to provide a heater having sufficient symmetry to ensure that drops will be ejected in a direction perpendicular to the orifice plane. An electrical heater surrounds a central bore on a substrate. Electrical leads contact the heater so that the heater can be selectively operated.

In conventional ink jet technology such as thermal ink jet, the ink meniscus remains in the nozzle bore until ejected. However, in ink jet print heads wherein the ink meniscus extends above the nozzle bore and actually spreads along the surface of the print head, it has been conventional thought that there had to be a sharp physical edge, such as a surface height step, upon which the ink meniscus could "pin" so as to keep the meniscus from expanding outwardly along the upper surface of the print head. Much inventive effort has been devoted to the manufacture of structures to pin the ink meniscus. Unfortunately, the configuration that provided a hard edge was difficult to manufacture and hard to clean.

DISCLOSURE OF THE INVENTION

According to a feature of the present invention, it has unexpectantly been found that a sharp physical edge upon which the ink meniscus could "pin" is not needed to keep the meniscus from expanding outwardly along the upper surface of ink jet print heads wherein the ink meniscus extends above the nozzle bore.

Accordingly, the present invention provides a heater having an upper surface which is coplanar with the surrounding dielectric material so that the entire device is flat in all regions along the ink-to-solid contact line of the meniscus. The principals of operation of the device in this case are quite different than prior art devices which rely on meniscus pinning at the edges of patterned material layers, since there are no distinguishing surface features to pin the meniscus.

It is a feature of the present invention to provide apparatus for controlling ink in an ink jet printer including a print head of the type wherein ink forms a meniscus above a nozzle bore and spreads along an upper surface of the print head. The print head includes a substrate having an upper surface; an ink delivery channel below the substrate; and a nozzle bore through the substrate and opening below the substrate into the ink delivery channel to establish an ink flow path. A source of pressurized ink communicates with the ink delivery channel such that ink tends to form a meniscus on the upper surface of the heater. A resistive heater lies about at least a portion of the nozzle bore, the heater having an upper surface which is coplanar with a surrounding portion of the upper surface of the substrate, whereby the print head is flat in regions along an ink-to-solid contact line of the meniscus.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
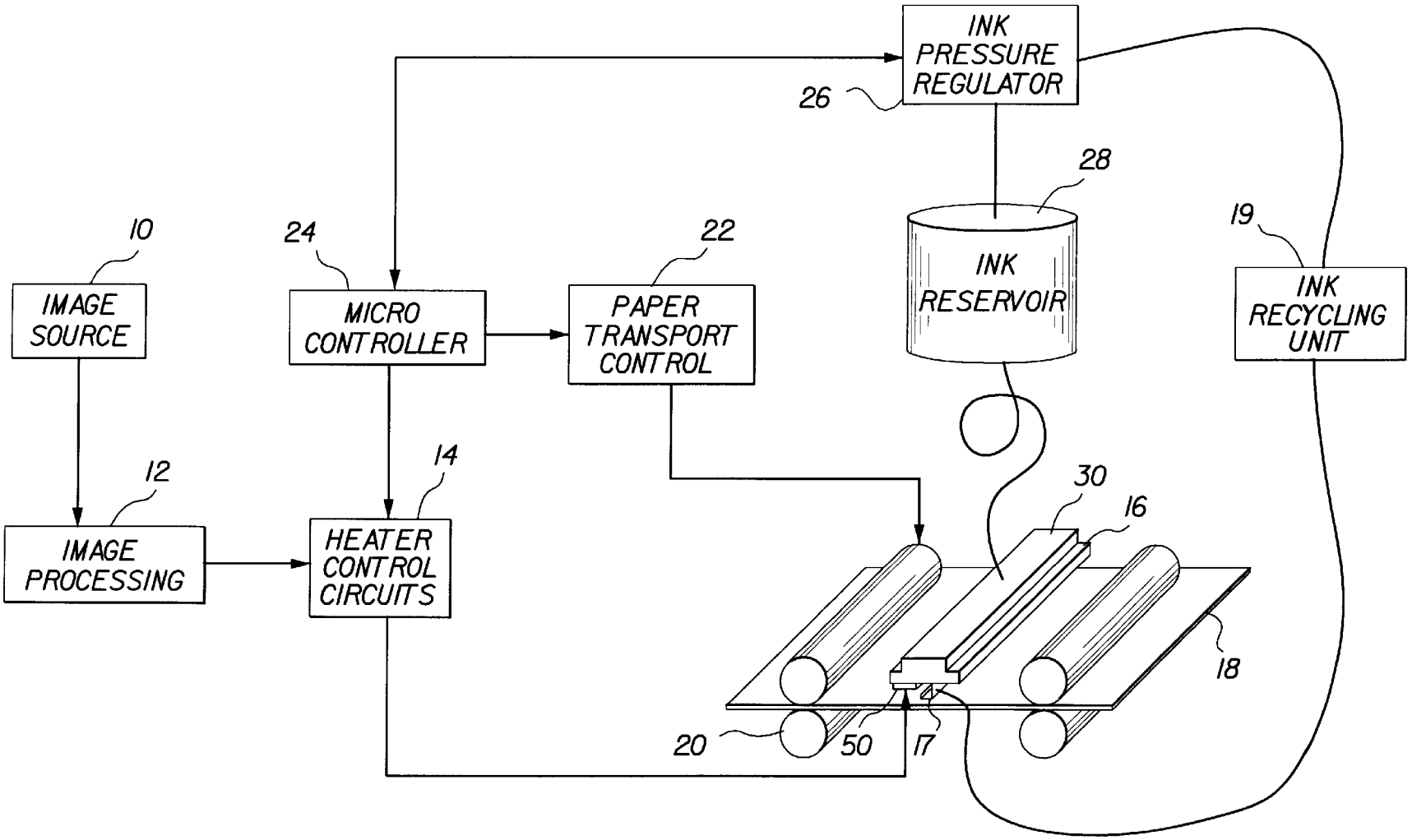
FIG. 1 shows a simplified block schematic diagram of one exemplary printing apparatus according to the present invention.

The present description will be directed in particular to elements forming part of, or cooperating more directly with, apparatus in accordance with the present invention. It is to be understood that elements not specifically shown or described may take various forms well known to those skilled in the art. While the invention is described below in the environment of a continuous ink jet printer, it will be noted that the invention can be used with drop on demand ink jet printers Referring to FIG. 1, a continuous ink jet printer system includes an image source 10 such as a scanner or computer which provides raster image data, outline image data in the form of a page description language, or other forms of digital image data. This image data is converted to half-toned bitmap image data by an image processing unit 12 which also stores the image data in memory. A plurality of heater control circuits 14 read data from the image memory and apply time-varying electrical pulses to a set of nozzle heaters 50 that are part of a print head 16. These pulses are applied at an appropriate time, and to the appropriate nozzle, so that drops formed from a continuous ink jet stream will form spots on a recording medium 18 in the appropriate position designated by the data in the image memory.

Recording medium 18 is moved relative to print head 16 by a recording medium transport system 20, which is electronically controlled by a recording medium transport control system 22, and which in turn is controlled by a micro-controller 24. The recording medium transport system shown in FIG. 1 is a schematic only, and many different mechanical configurations are possible. For example, a transfer roller could be used as recording medium transport system 20 to facilitate transfer of the ink drops to recording medium 18. Such transfer roller technology is well known in the art. In the case of page width print heads, it is most convenient to move recording medium 18 past a stationary print head. However, in the case of scanning print systems, it is usually most convenient to move the print head along one axis (the sub-scanning direction) and the recording medium along an orthogonal axis (the main scanning direction) in a relative raster motion.

Ink is contained in an ink reservoir 28 under pressure. In the non-printing state, continuous ink jet drop streams are unable to reach recording medium 18 due to an ink gutter 17 that blocks the stream and which may allow a portion of the ink to be recycled by an ink recycling unit 19. The ink recycling unit reconditions the ink and feeds it back to reservoir 28. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 28 under the control of ink pressure regulator 26.

The ink is distributed to the back surface of print head 16 by an ink channel device 30. The ink preferably flows through slots and/or holes etched through a silicon substrate of print head 16 to its front surface, where a plurality of nozzles and heaters are situated. With print head 16 fabricated from silicon, it is possible to integrate heater control circuits 14 with the print head.

Figure 2A:
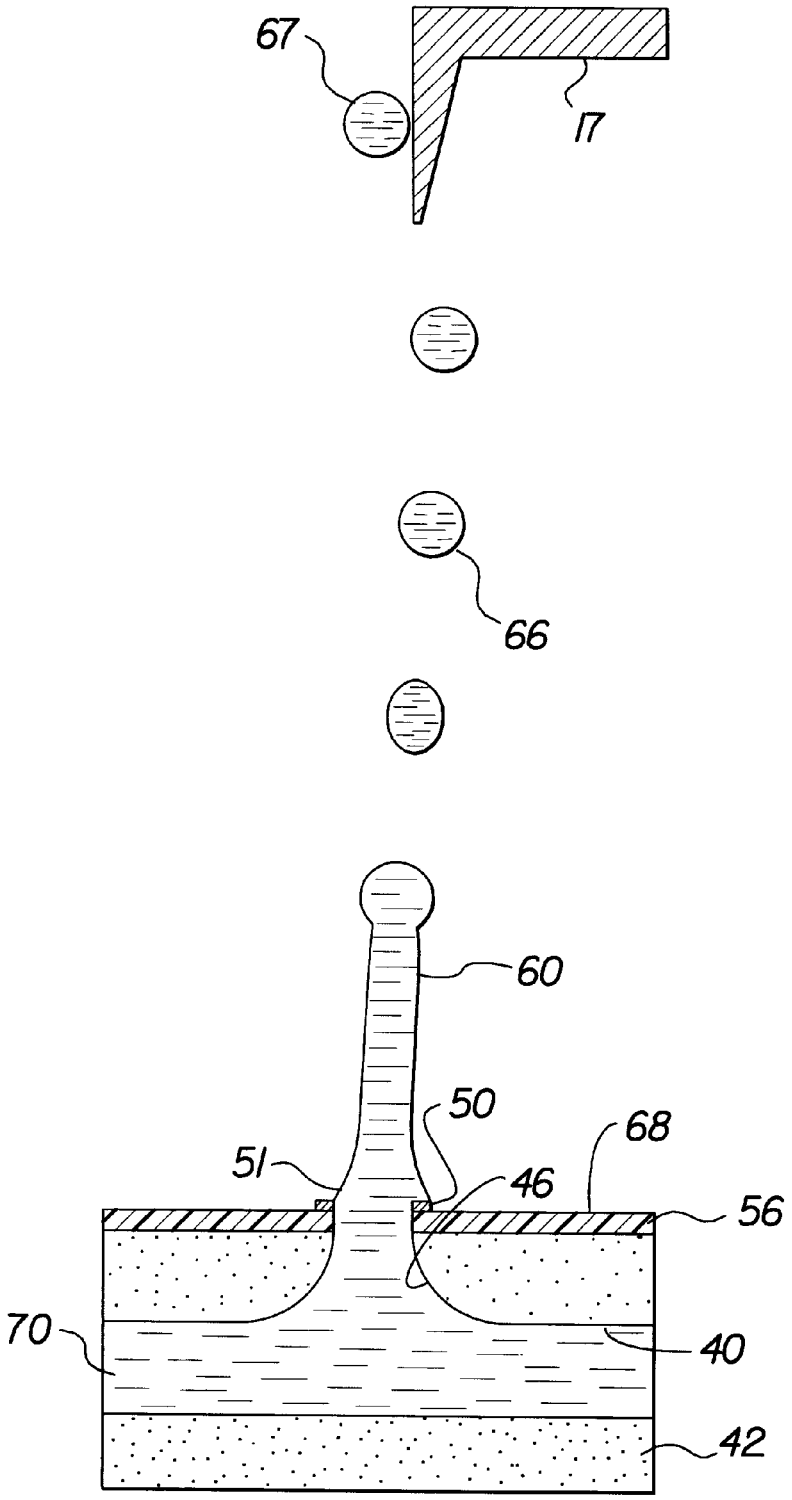
FIG. 2A shows a cross section of a nozzle with asymmetric heating deflection.

FIG. 2A is a cross-sectional view of one nozzle tip of an array of such tips that form continuous ink jet print head 16 of FIG. 1 according the above-cited co-pending application Ser. No. 08/954,317. An ink delivery channel 40, along with a plurality of nozzle bores 46 are etched in a substrate 42, which is silicon in this example. Delivery channel 40 and nozzle bores 46 may be formed by anisotropic wet etching of silicon, using a $p^+$etch stop layer to form the nozzle bores. Ink 70 in delivery channel 40 is pressurized above atmospheric pressure, and forms a stream 60. At a distance above nozzle bore 46, stream 60 breaks into a plurality of drops 66 due to a periodic heat pulse supplied by a heater 50.

Figure 2B:
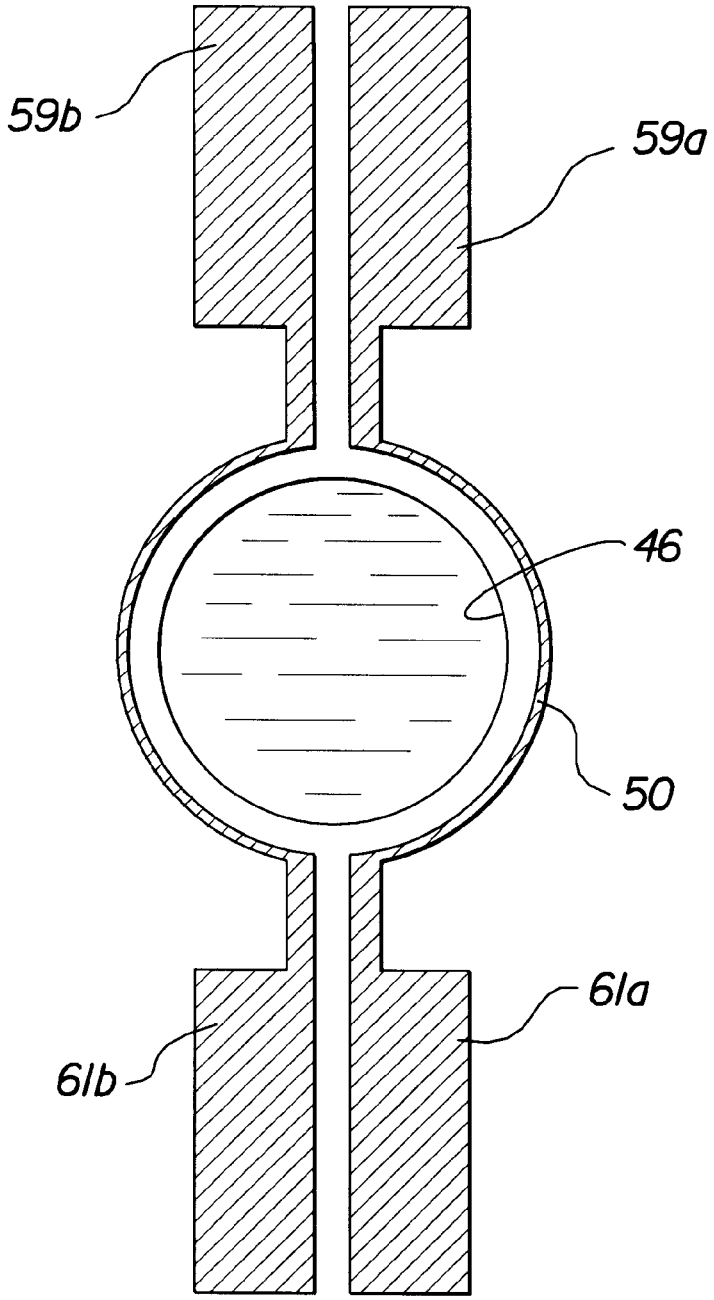
FIG. 2B shows a top view of the nozzle with asymmetric heating deflection.

Referring to FIG. 2B, the heater of the above-cited co-pending application Ser. No. 08/954,317 has two sections, each covering approximately one-half of the nozzle perimeter. Power connections 59*a* and 59*b* and ground connections 61*a* and 61*b* from the drive circuitry to heater annulus 50 are also shown. Stream 60 (FIG. 2A) may be deflected by an asymmetric application of heat by supplying electrical current to one, but not both, of the heater sections. With stream 60 being deflected, drops 66 may be blocked from reaching recording medium 18 by a cut-off device such as an ink gutter 17. In an alternate printing scheme, ink gutter 17 may be placed to block undeflected drops 67 so that deflected drops 66 will be allowed to reach recording medium 18.

The heater was made of polysilicon doped at a level of about thirty ohms/square, although other resistive heater material could be used. Heater 50 is separated from substrate 42 by thermal and electrical insulating layers 56 to minimize heat loss to the substrate. The nozzle bore may be etched allowing the nozzle exit orifice to be defined by insulating layers 56. The layers in contact with the ink can be passivated with a thin film layer for protection. The print head surface can be coated with a hydrophobizing layer 68 to prevent accidental spread of the ink across the front of the print head.

Figure 3:
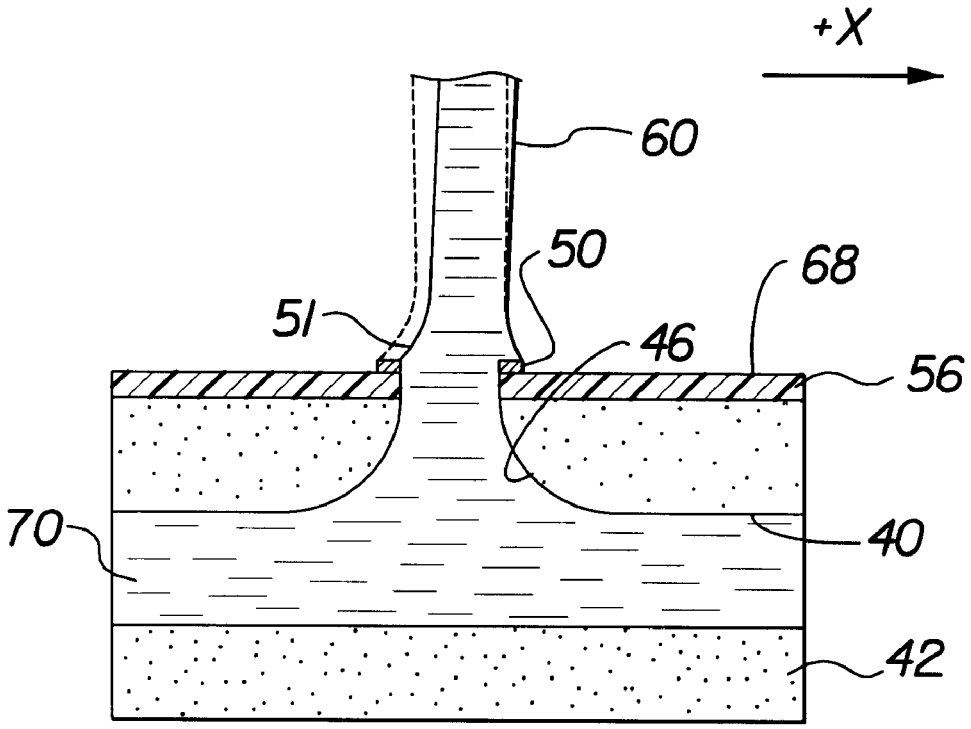
FIG. 3 is an enlarged cross section view of the nozzle with asymmetric heating deflection.

FIG. 3 is an enlarged view of the nozzle area of the above-cited co-pending application Ser. No. 08/954,317. A meniscus 51 is formed where the liquid stream makes contact with the heater edges. When an electrical pulse is supplied to one of the sections of heater 50 (the left-hand side in FIG. 3), the contact line that is initially on the outside edge of the heater (illustrated by the dotted line) is moved inwards toward the inside edge of the heater (illustrated by the solid line). The other side of the stream (the right-hand side in FIG. 3) stays pinned to the non-activated heater. The effect of the inward moving contact line is to deflect the stream in a direction away from the active heater section (left to right in FIG. 3 or in the +x direction). At some time after the electrical pulse ends the contact line returns toward the outside edge of the heater.

In conventional ink jet technology such as thermal ink jet, the ink meniscus remains in the nozzle bore until ejected. However, in ink jet print heads wherein the ink meniscus extends above the nozzle bore and actually spreads along the surface of the print head, it has been conventional thought that there had to be a sharp physical edge upon which the ink meniscus could "pin" so as to keep the meniscus from expanding outwardly along the upper surface of the print head. Unfortunately, the configuration that provided a sharp physical edge was difficult to manufacture and hard to clean.

According to a feature of the present invention, it has unexpectantly been found that a sharp physical edge upon which the ink meniscus could "pin" is not needed to keep the meniscus from expanding outwardly along the upper surface of ink jet print heads wherein the ink meniscus extends above the nozzle bore and that a planar surface is advantageous in fabrication and operation of such devices. Accordingly, the present invention provides a heater having an upper surface which is coplanar with the surrounding dielectric material so that the entire device is flat in all regions along the ink-to-solid contact line of the meniscus. The operation principals of the device in this case are quite different than prior art devices which rely on meniscus pinning at the edges of patterned material layers, since there are no distinguishing surface features to pin the meniscus.

Figure 4A:
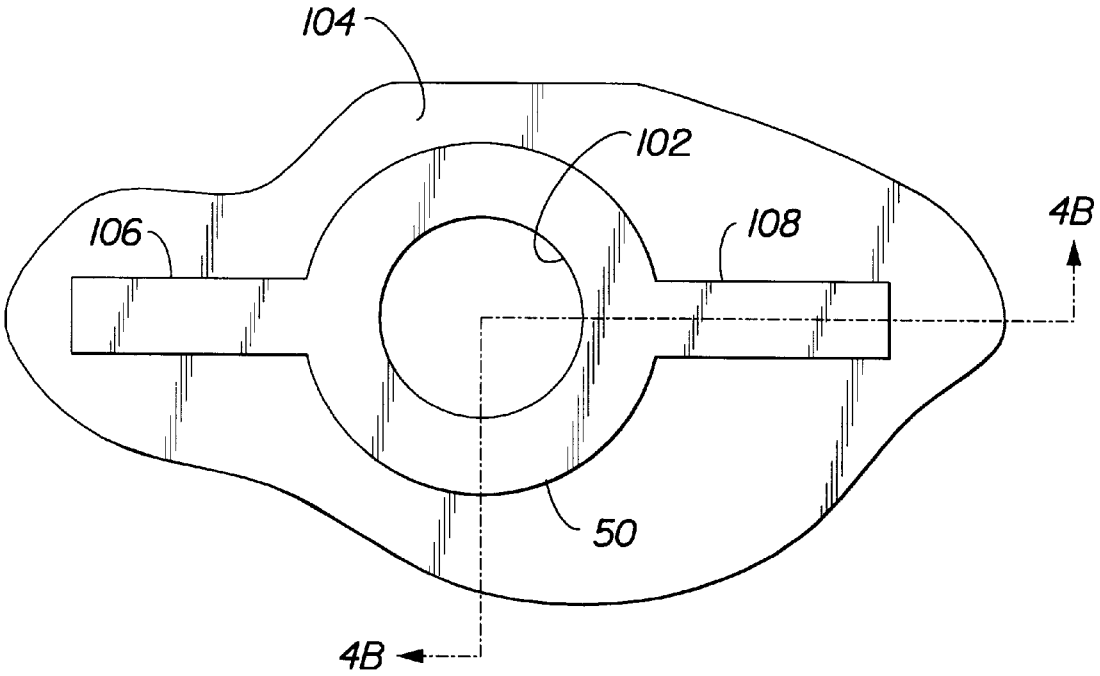
FIG. 4A is a top view of a heater.
Figure 4B:
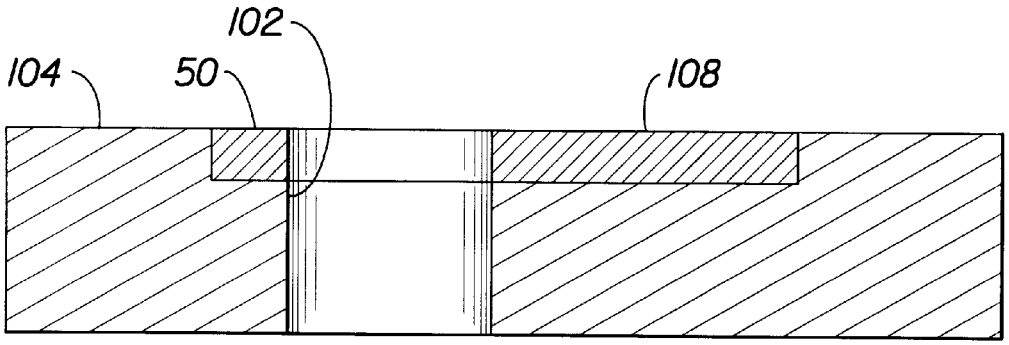
FIG. 4B is a section view of a print head having the heater of FIG. 4A.

As shown in FIGS. 4A and 4B, an electrical resistance heater 50 surrounds a central bore 102 on a substrate 104. Electrical leads 106 and 108 contact or are formed integral with the heater so that the heater can be selectively operated. As best seen in FIG. 4B, heater 50 is inlaid into substrate 104 so as to provide an entirely flat device. In FIG. 4B, the inner edge of the heater is aligned to (extends radially to) the surface of bore 102.

Figure 5:
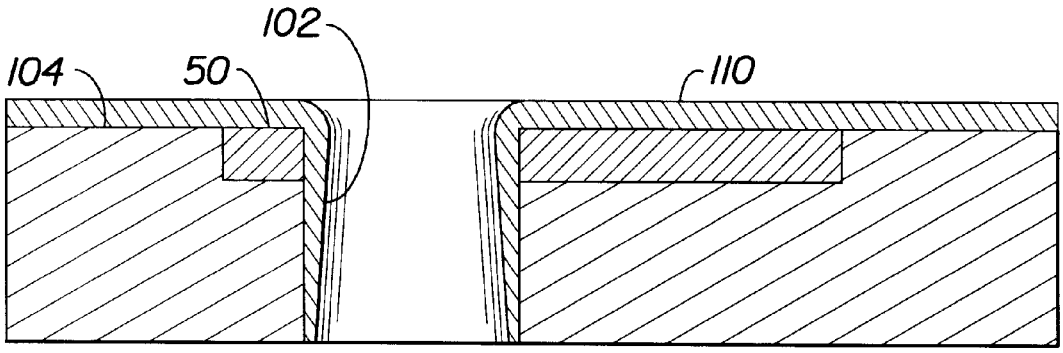
FIG. 5 is a sectional view of another embodiment of a print head according to the present invention.

In an alternative embodiment of the present invention illustrated in FIG. 5, a passivation layer 110 is shown which extends into bore 102, across the surface of heater 50, and over the exposed portions of substrate 104. The passivation layer serves to protect the surfaces and additionally renders all areas of the surface chemically identical.

Figure 6:
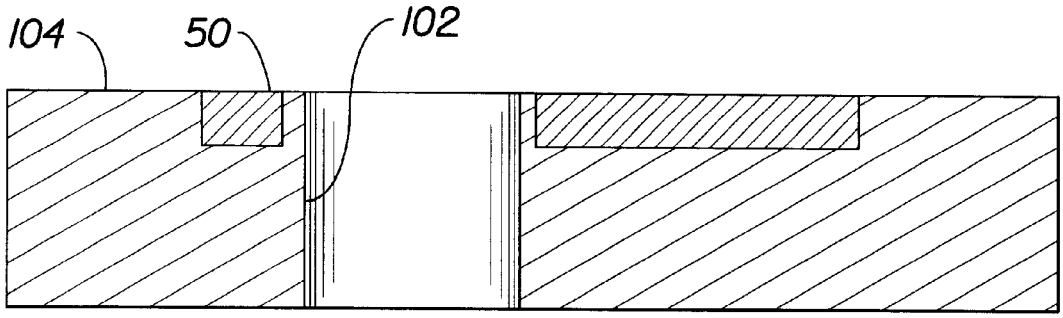
FIG. 6 is a sectional view of another embodiment of a print head according to the present invention.

In yet another embodiment of the present invention illustrated in FIG. 6, the radially inner edge of heater 50 is radially offset from the inner surface of bore 102 so the heater is separated from the bore region. No passivation is required inside the bore in this case, and bore etching after deposit of any passivation layer is possible.

Heater 50 may be inlaid into substrate 104 by a fabrication process comprising the steps of sequentially etching a trench in the surface of substrate 104 in the form of the heater and the heater leads; depositing the heater material into the etched trench; and the removing, for example by a planarization process such as polishing, the deposited heater material which is higher than the non-etched portions of the substrate. Thereby, the inlaid heater is formed having a surface profile which is flat over the entire region in which the ink might contact any solid surface.

Figure 7A:
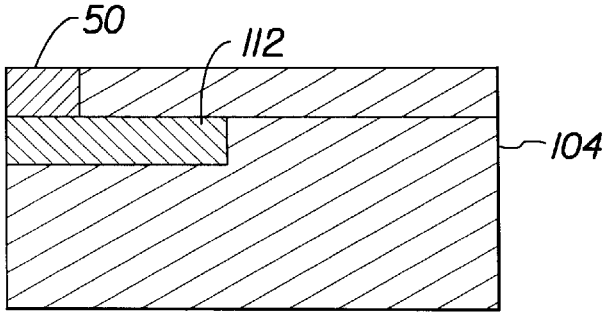
FIGS. 7A–7H are a sectional views of other embodiments of a print heads according to the present invention.

FIGS. 7A–7H illustrate several possible embodiments of print head configurations according to the present invention. In FIG. 7A, an inlaid heater 50 abuts an inlaid electrical lead trace 112 to provide an entirely flat device also having preferred spatial relationships between the edges of the heater, the trace, and bore 102 . The inner edge of the heater is aligned to the edge of the bore.

Figure 7B:
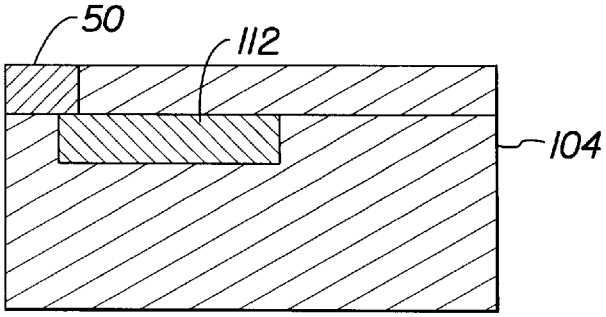

In FIG. 7A, the inner edge of heater 50 is also aligned to the inner edge of inlaid trace 112, while in FIG. 7B, the inner edge of heater 50 is offset from the inner edge of trace 112 so the trace is separated from the bore region.

Figure 7C:
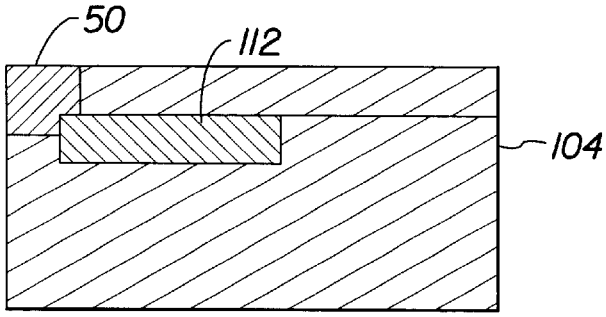
Figure 7D:
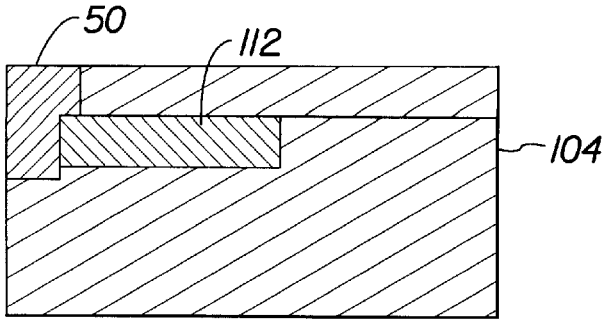
Figure 7E:
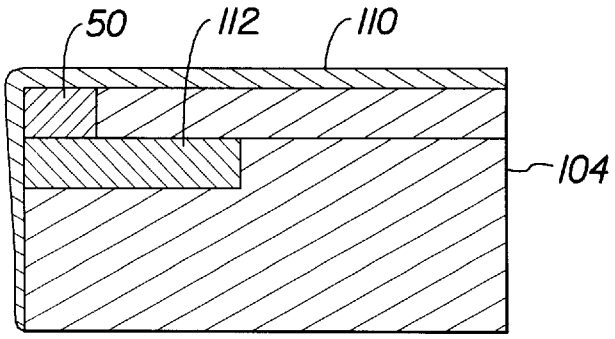
Figure 7F:
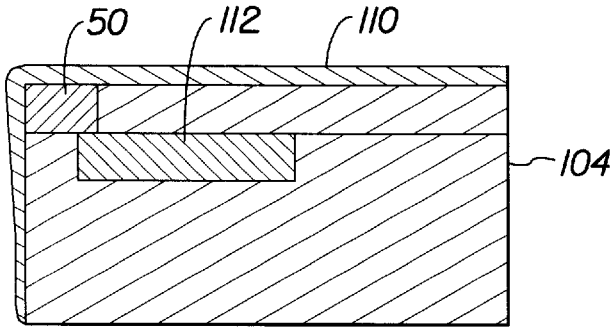

In FIG. 7C, the heater is offset from the trace and is extended so that its bottom surface lies below the top surface of the inlaid trace but above the bottom surface of the inlaid trace. In FIG. 7D, the heater is offset from the trace and is extended so that its bottom surface lies below the bottom surface of the inlaid trace. FIGS. 7E–7H are identical to FIGS. 7A–7D except that a passivation layer 110 is shown which extends into the bore.

Figure 7G:
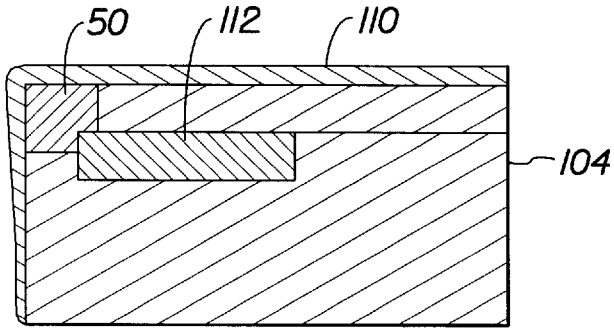
Figure 7H:
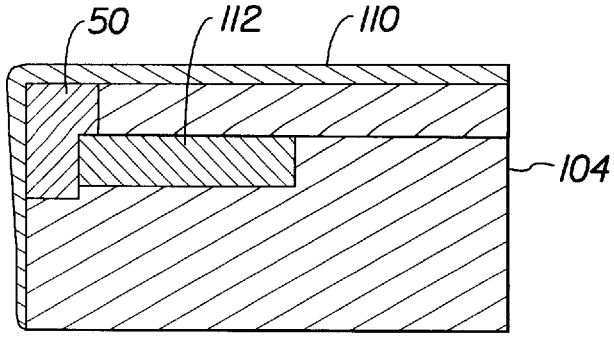
Figure 8:
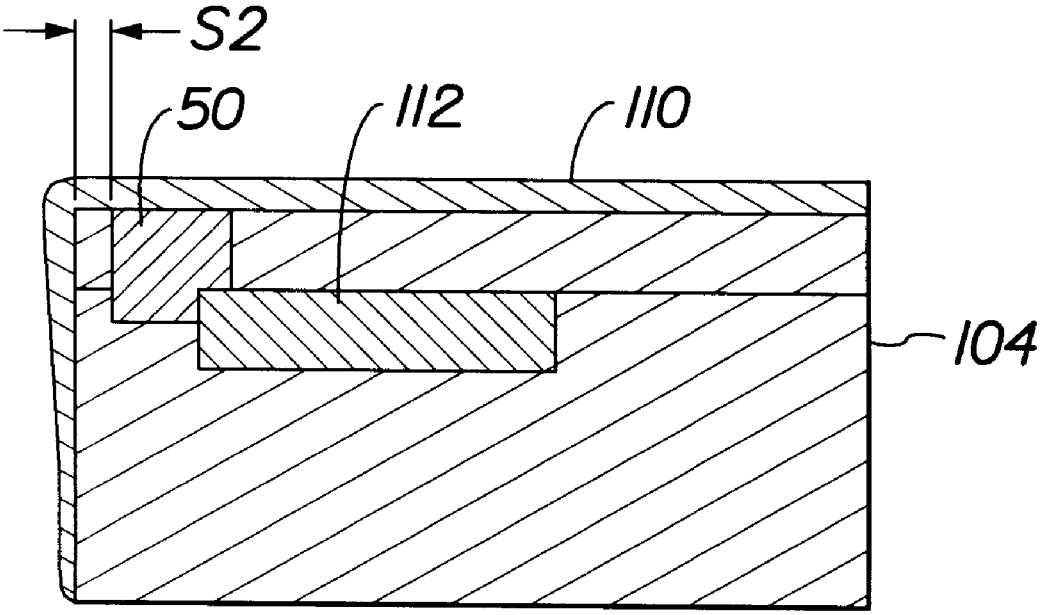
FIG. 8 is a sectional view of another embodiment of a print head according to the present invention.

FIG. 8 is similar to FIG. 7G except the edge of the bore is no longer aligned to the inner edge of the heater. In FIG. 8, the edge of the bore is spaced away from the inner edge of the heater by an distance s2.

Figure 9A:
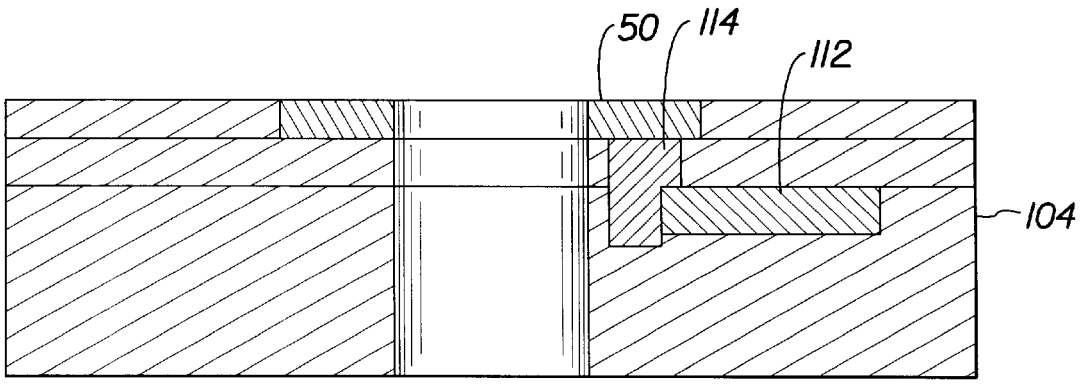
FIGS. 9A–9C are a sectional views of other embodiments of a print heads according to the present invention.
Figure 9B:
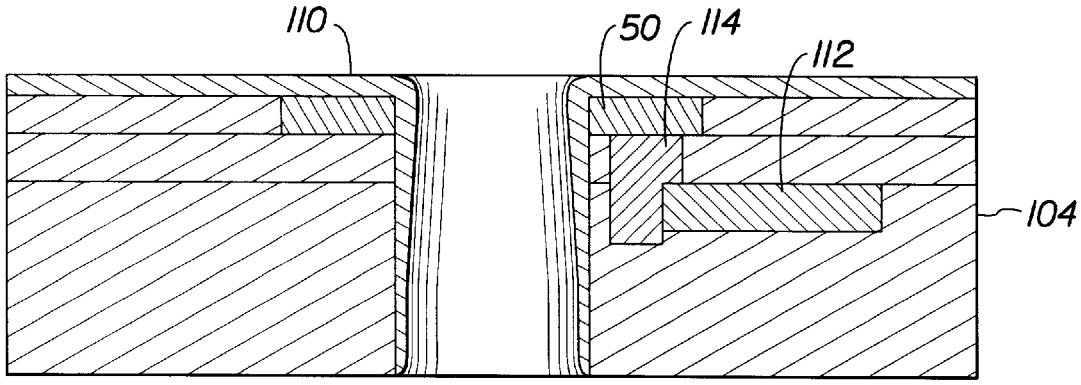
Figure 9C:
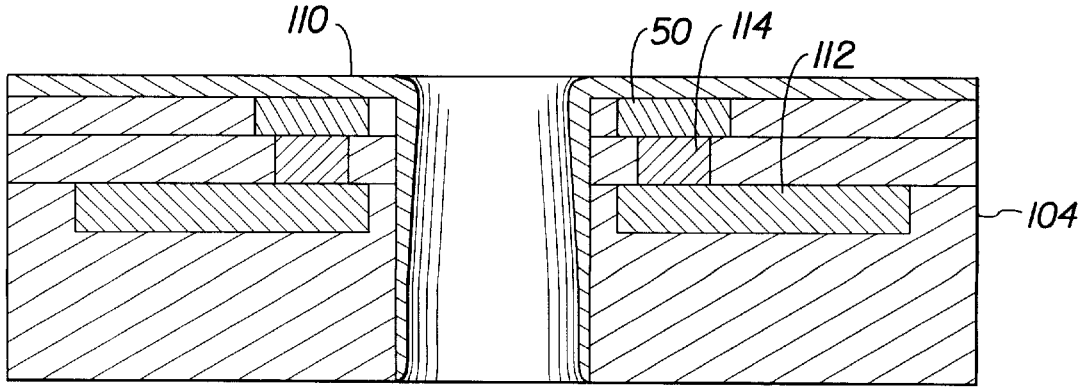

In yet another embodiment of a fully planar device, FIGS. 9A–9C show an inlaid heater 50, a via 114 well known in the art of semiconductor fabrication, and an inlaid trace 112 that are combined together to provide an entirely flat device. As in the case of the structures shown in previous figures, the structures of FIGS. 9A–9C may also be provided with various spatial relationships between the edges of the heater, the trace, and the bore. In FIG. 9A, the inner edge of the heater is shown aligned to the bore edge but offset from the inner edge of the via. The edge of the inlaid trace is shown offset from the outer edge of the via so that inlaid trace electrically contacts the via along a vertical path. The same structure is shown in FIG. 9B expect that a passivation layer is shown which extends into the bore. FIG. 9C shows an inlaid heater whose inner edges are offset with respect to the edge of the bore.

The invention has been described in detail with particular reference to preferred embodiments thereof, but it will be understood that variations and modifications can be effected within the spirit and scope of the invention.

What is claimed is:

1. A print head for an ink jet printer of the type wherein ink forms a meniscus above a nozzle bore and spreads along an upper surface of the print head; said print head comprising:

a substrate having an upper surface;

an ink delivery channel below the substrate;

a nozzle bore through the substrate and opening below the substrate into the ink delivery channel to establish an ink flow path;

a source of pressurized ink communicating with the ink delivery channel such that ink tends to form a meniscus on the upper surface of the heater; and a resistive heater about at least a portion of the nozzle bore, said heater having an upper surface which is coplanar with a surrounding portion of the upper surface of the substrate, whereby the print head is flat in regions along an ink-to-solid contact line of the meniscus.

2. A print head as defined in claim 1 further comprising:

a plurality of electrodes contacting the heater at spaced-apart positions below the upper surface of the substrate;

a power source; and an actuator adapted to apply the power source across pairs of the electrodes so as to activate said heater.

3. A print head as defined in claim 2 wherein:

the substrate comprises at least two dielectric layers contacting each other at an interface; and the electrodes are buried at the interface of the dielectric layers.

4. A print head as defined in claim 3 wherein the electrodes terminate radially outwardly of the bore.

5. A print head as defined in claim 3 wherein the electrodes extend radially to the bore.

6. A print head as defined in claim 5 wherein the electrodes are covered by a passivation layer at the bore.

7. A print head as defined in claim 1 wherein the heater is annular.

8. A print head as defined in claim 1 wherein the heater is annular and uninterrupted.

9. A print head as defined in claim 1 wherein the heater is polysilicon doped at a level of about 30 ohms/square.

10. A print head for an ink jet printer of the type wherein ink forms a meniscus above a nozzle bore and spreads along an upper surface of the print head; said print head comprising:

a substrate having an upper surface;

an ink delivery channel below the substrate;

a nozzle bore through the substrate and opening below the substrate into the ink delivery channel to establish an ink flow path;

a source of pressurized ink communicating with the ink delivery channel such that ink tends to form a meniscus on the upper surface of the heater and the ink flows in a continuous stream from the nozzle bore;

a power source;

a resistive heater about at least a portion of the nozzle bore, said heater having an upper surface which is coplanar with a surrounding portion of the upper surface of the substrate, whereby the print head is flat in regions along an ink-to-solid contact line of the meniscus the heater defines a plurality of sections, each section having a pair of electrodes; and an actuator adapted to apply the power source across pairs of the electrodes so as to activate said heater to deflect the stream in a controlled direction of deflection and by a controlled amount of deflection, the actuator is adapted to apply the power source across selected pairs of the electrodes such that actuation of only a portion of the heater sections produces an asymmetric application of heat to the stream to control the direction and the amount of deflection of the stream as a function of the activated heater sections.

* * * * *